US007759032B2

(12) United States Patent
Yanus et al.

(10) Patent No.: US 7,759,032 B2
(45) Date of Patent: Jul. 20, 2010

(54) PHOTORECEPTOR WITH OVERCOAT LAYER

(75) Inventors: John F. Yanus, Webster, NY (US); Kenny-Tuan T. Dinh, Webster, NY (US); Markus R. Silvestri, Fairport, NY (US); Yuhua Tong, Webster, NY (US); Dale S. Renfer, Webster, NY (US); T. Edwin Freeman, Woodstock, GA (US); M. John Hinckel, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 461 days.

(21) Appl. No.: 11/275,134

(22) Filed: Dec. 13, 2005

(65) Prior Publication Data

US 2007/0134573 A1 Jun. 14, 2007

(51) Int. Cl.
*G03G 5/147* (2006.01)

(52) U.S. Cl. ..... 430/66; 430/58.65; 430/58.75; 430/59.6; 399/159

(58) Field of Classification Search ..... 430/58.65, 430/58.75, 59.6, 66; 399/159
See application file for complete search history.

(56) References Cited

U.S. PATENT DOCUMENTS

| | | | | |
|---|---|---|---|---|
| 3,121,006 | A | 2/1964 | Middleton et al. | |
| 4,050,935 | A | 9/1977 | Limburg et al. | |
| 4,125,678 | A * | 11/1978 | Stvan et al. | 428/514 |
| 4,281,054 | A | 7/1981 | Horgan et al. | |
| 4,297,425 | A | 10/1981 | Pai et al. | |
| 4,298,697 | A | 11/1981 | Baczec et al. | |
| 4,338,390 | A | 7/1982 | Lu | |
| 4,390,609 | A * | 6/1983 | Wiedemann | 430/58.5 |
| 4,457,994 | A | 7/1984 | Pai et al. | |
| 4,560,635 | A | 12/1985 | Hoffend et al. | |
| 4,599,286 | A | 7/1986 | Limburg et al. | |
| 4,871,634 | A | 10/1989 | Limburg et al. | |
| 5,368,967 | A | 11/1994 | Schank et al. | |
| 5,418,107 | A | 5/1995 | Nealey et al. | |
| 5,681,679 | A | 10/1997 | Schank et al. | |
| 5,702,854 | A | 12/1997 | Schank et al. | |
| 5,709,974 | A | 1/1998 | Yuh et al. | |
| 5,976,744 | A | 11/1999 | Fuller et al. | |
| 6,004,709 | A | 12/1999 | Renfer et al. | |
| 6,207,334 | B1 * | 3/2001 | Dinh et al. | 430/58.8 |
| 2007/0072101 | A1 * | 3/2007 | Dinh et al. | 430/66 |

* cited by examiner

*Primary Examiner*—Mark F Huff
*Assistant Examiner*—Rachel L Burney
(74) *Attorney, Agent, or Firm*—Oliff & Berridge, PLC

(57) ABSTRACT

An electrophotographic imaging member includes a substrate, a charge generating layer, a charge transport layer, and an overcoating layer, where the overcoating layer includes a terphenyl arylamine dissolved or molecularly dispersed in a polymer binder.

15 Claims, 3 Drawing Sheets

PHOTORECEPTOR WITH OVERCOAT LAYER

BACKGROUND

This disclosure relates to electrophotographic imaging members and, more specifically, to layered photoreceptor structures with an improved overcoat layer. In particular, this disclosure relates to electrophotographic imaging members with an improved overcoat layer comprising a terphenyl hole transporting molecule. This disclosure also relates to processes for making and using the imaging members.

Electrophotographic imaging members, i.e. photoreceptors, typically include a photoconductive layer formed on an electrically conductive substrate. The photoconductive layer is an insulator in the dark so that electric charges are retained on its surface. Upon exposure to light, the charge is dissipated.

Many advanced imaging systems are based on the use of small diameter photoreceptor drums. The use of small diameter drums places a premium on photoreceptor life. A major factor limiting photoreceptor life in copiers and printers, is wear. The use of small diameter drum photoreceptors exacerbates the wear problem because, for example, 3 to 10 revolutions are required to image a single letter size page. Multiple revolutions of a small diameter drum photoreceptor to reproduce a single letter size page can require up to 1 million cycles from the photoreceptor drum to obtain 100,000 prints, a desirable goal for commercial systems.

For low volume copiers and printers, bias charging rolls (BCR) are desirable because little or no ozone is produced during image cycling. However, the micro corona generated by the BCR during charging, damages the photoreceptor, resulting in rapid wear of the imaging surface, e.g., the exposed surface of the charge transport layer. For example, wear rates can be as high as about 16 microns per 100,000 imaging cycles. Similar problems are encountered with bias transfer roll (BTR) systems. One approach to achieving longer photoreceptor drum life is to form a protective overcoat on the imaging surface, e.g. the charge transporting layer of a photoreceptor. This overcoat layer must satisfy many requirements, including transporting holes, resisting image deletion, resisting wear, avoidance of perturbation of underlying layers during coating.

Various overcoats employing alcohol soluble polyamides have been proposed in the prior art. One of the earliest ones is an overcoat comprising an alcohol soluble polyamide without any methyl methoxy groups (Elvamide) containing N,N'-diphenyl-N,N'-bis(3-hydroxyphenyl)-[1,1'-biphenyl]-4,4'-diamine. This overcoat is described in U.S. Pat. No. 5,368,967, the entire disclosure thereof being incorporated herein by reference. Although this overcoat had very low wear rates in machines employing corotrons for charging, the wear rates were higher in machines employing BCR. A cross linked polyamide overcoat overcame this shortcoming. This overcoat comprised a cross linked polyamide (e.g. Luckamide) containing N,N'-diphenyl-N,N'-bis(3-hydroxyphenyl)-[1,1'-biphenyl]-4,4'-diamine. In order to achieve cross linking of the polyamide polymer, Luckamide, having methyl methoxy groups was employed along with a catalyst such as oxalic acid. This tough overcoat is described in U.S. Pat. No. 5,702,854, the entire disclosure thereof being incorporated herein by reference. With this overcoat, very low wear rates were obtained in machines employing bias charging rolls (BCR) and Bias Transfer Rolls (BTR). Durable photoreceptor overcoatings containing cross linked polyamide (e.g. Luckamide) containing N,N'-diphenyl-N,N'-bis(3-hydroxyphenyl)-[1,1'-biphenyl]-4,4'--diamine (DHTBD) (Luckamide-DHTBD) have been prepared using oxalic acid and trioxane to improve photoreceptor life by at least a factor of 3 to 4. Such improvement in the bias charging roll (BCR) wear resistance involved crosslinking of Luckamide under heat treatment, e.g. 110° C.-120° C. for 30 minutes. However, adhesion of this overcoat to certain photoreceptor charge transport layers, containing certain polycarbonates (e.g., Z-type 300) and charge transport materials (e.g., bis-N,N-(3,4-dimethylphenyl)-N-(4-biphenyl)amine and N,N'-diphenyl-N,N'-bis(3-methylphenyl)-[1,1'-biphenyl]-4,4'-diamine) is greatly reduced under such drying conditions. On the other hand, under drying conditions of below about 110° C., the overcoat adhesion to the charge transport layer was good, but the overcoat had a high rate of wear. Thus, there was an unacceptably small drying conditions window for the overcoat to achieve the targets of both adhesion and wear rate.

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 6,004,709 discloses an allyloxypolyamide composition, the allyloxypolyamide being represented by a specific formula. The allyloxypolyamide may be synthesized by reacting an alcohol soluble polyamide with formaldehyde and an allylalcohol. The allyloxypolyamide may be cross linked by a process selected from the group consisting of (a) heating an allyloxypolyamide in the presence of a free radical catalyst, and (b) hydrosilation of the double bond of the allyloxy group of the allyloxypolyamide with a silicon hydride reactant having at least 2 reactive sites. A preferred article comprises a substrate, at least one photoconductive layer, and an overcoat layer comprising a hole transporting hydroxy arylamine compound having at least two hydroxy functional groups, and a cross linked allyloxypolyamide film forming binder. A stabilizer may be added to the overcoat.

U.S. Pat. No. 5,976,744 discloses an electrophotographic imaging member including a supporting substrate coated with at least one photoconductive layer and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating. The electrophotographic imaging member may be imaged in a process.

U.S. Pat. No. 5,709,974 discloses an electrophotographic imaging member including a charge generating layer, a charge transport layer and an overcoating layer, the transport layer including a charge transporting aromatic diamine molecule in a polystyrene matrix and the overcoating layer including a hole transporting hydroxy arylamine compound having at least two hydroxy functional groups and a polyamide film forming binder capable of forming hydrogen bonds with the hydroxy functional groups of the hydroxy arylamine compound. This imaging member is utilized in an imaging process.

U.S. Pat. No. 5,368,967 discloses an electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process. Specific materials including Elvamide polyamide and N,N'-diphenyl-N,N'-bis(3-hydroxyphenyl)-[1,1'-biphenyl]-4,4'--diamine and bis-[2-methyl-4-(N-2-hydroxyethyl-N-ethyl-aminophenyl)]-phenylmethane are disclosed in this patent.

U.S. Pat. No. 4,871,634 discloses an electrostatographic imaging member which contains at least one electrophotoconductive layer, the imaging member comprising a photogenerating material and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

U.S. Pat. No. 4,297,425 discloses a layered photosensitive member comprising a generator layer and a transport layer containing a combination of diamine and triphenyl methane molecules dispersed in a polymeric binder.

U.S. Pat. No. 4,050,935 discloses a layered photosensitive member comprising a generator layer of trigonal selenium and a transport layer of bis(4-diethylamino-2-methylphenyl) phenylmethane molecularly dispersed in a polymeric binder.

U.S. Pat. No. 4,457,994 discloses a layered photosensitive member comprising a generator layer and a transport layer containing a diamine type molecule dispersed in a polymeric binder and an overcoat containing triphenyl methane molecules dispersed in a polymeric binder.

U.S. Pat. No. 4,281,054 discloses an imaging member comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,599,286 discloses an electrophotographic imaging member comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

U.S. Pat. No. 5,418,107 discloses a process for fabricating an electrophotographic imaging member including providing a substrate to be coated, forming a coating comprising photoconductive pigment particles having an average particle size of less than about 0.6 micrometer dispersed in a solution of a solvent comprising n-alkyl acetate having from 3 to 5 carbon atoms in the alkyl group and a film forming polymer consisting essentially of a film forming polymer having a polyvinyl butyral content between about 50 and about 75 mol percent, a polyvinyl alcohol content between about 12 and about 50 mol percent, and a polyvinyl acetate content is between about 0 to 15 mol percent, the photoconductive pigment particles including a mixture of at least two different phthalocyanine pigment particles free of vanadyl phthalocyanine pigment particles, drying the coating to remove substantially all of the alkyl acetate solvent to form a dried charge generation layer comprising between about 50 percent and about 90 percent by weight of the pigment particles based on the total weight of the dried charge generation layer, and forming a charge transport layer.

Despite these various approaches, overcoat layers have possessed limited ability to transport charge through the protective layer due to the electronic nature of the small molecule and the polar nature of the media comprising the overcoat layer. While the above-described N,N'-diphenyl-N,N'-bis(3-hydroxyphenyl)-[1,1'-biphenyl]-4,4'-diamine has provided improved charge transport, the limited mobility still required relatively thin overcoating layers, on the order of 2-4 microns. These thin coatings in turn contributed to shorter useful lifetime, and in some cases the inability to provide ready photoreceptor replacement when necessary.

SUMMARY

This disclosure addresses some or all of the above problems, and others, by providing novel, phenolic small molecules of the terphenyl arylamine family. Such terphenyl arylamines possess high charge transport mobility in overcoating layers of photoreceptors. In embodiments, such improved charge transport mobility can be approximately a factor three in magnitude higher than the conventional phenolic biphenyl material N,N'-diphenyl-N,N'-bis(3-hydroxyphenyl)-[1,1'-biphenyl]-4,4'-diamine (DHTBD described above) presently used, on a weight percent basis. Furthermore, on a molar basis the improvement is even larger due to the larger molecular weight.

More particularly, in embodiments, the present disclosure provides an electrophotographic imaging member comprising:

a substrate, a charge generating layer, a charge transport layer, and an overcoating layer, said overcoating layer comprising a terphenyl arylamine dissolved or molecularly dispersed in a polymer binder.

The present disclosure also provides a process for forming an electrophotographic imaging member comprising:

providing an electrophotographic imaging member comprising a substrate, a charge generating layer, and a charge transport layer, and forming thereover an overcoating layer comprising a terphenyl arylamine dissolved or molecularly dispersed in a polymer binder.

Also provided are imaging processes using such electrophotographic imaging members.

BRIEF DESCRIPTION OF THE DRAWINGS

These and other advantages and features of this disclosure will be apparent from the following, especially when considered with the accompanying drawings, in which.

DETAILED DESCRIPTION OF PREFERRED EMBODIMENTS

Figure 1:
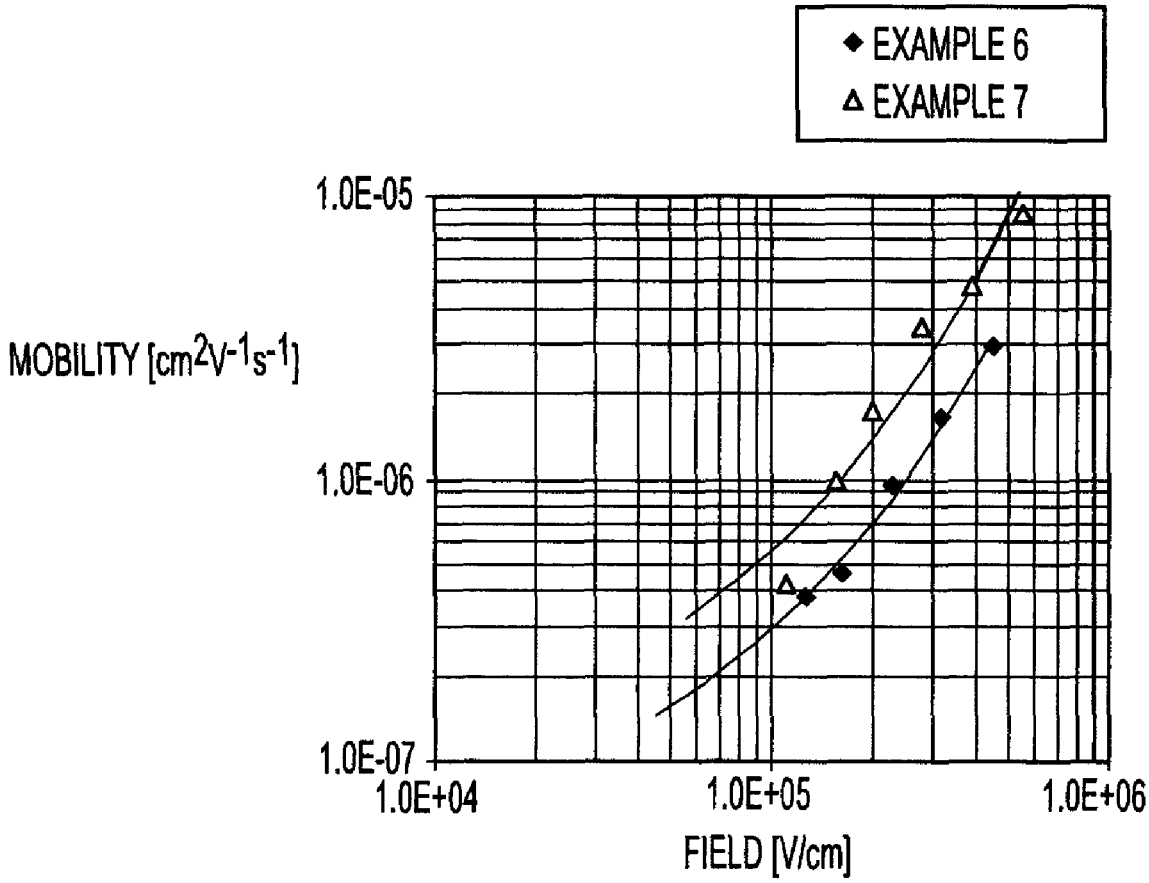
FIG. 1 is a graph showing a relationship between mobility and field for exemplary imaging members.

Electrophotographic imaging members are well known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer or substrate. The electrophotographic imaging layer may be a single layer that performs both charge generating and charge transport functions as is well known in the art or it may comprise multiple layers such as a charge generator layer and charge transport layer. Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" as used herein is defined as a charge transporting small molecule dispersed in the polymer, the small molecules being dispersed in the polymer on a molecular scale. Any suitable charge transporting or electrically active small molecule may be employed in the charge transport layer. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl) pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

Any suitable electrically inactive resin binder insoluble in the alcohol solvent used to apply the overcoat layer may be employed in the charge transport layer. Typical inactive resin binders include polycarbonate resin, polyester, polyarylate, polyacrylate, polyether, polysulfone, and the like. Molecular weights can vary, for example, from about 20,000 to about 150,000. Preferred binders include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyldiphenyl)carbonate (also referred to as bisphenol-C-polycarbonate) and the like. Any suitable charge transporting polymer may also be utilized in the charge transporting layer. The charge transporting polymer should be insoluble in any solvent employed to apply the subsequent overcoat layer described below, such as an alcohol solvent. These electrically active charge transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

To improve photoreceptor wear resistance, a protective overcoat layer is provided over the charge transport layer. The overcoat layer generally includes at least a film-forming resin and a terphenyl hole transporting molecule, preferably a terphenyl diamine hole transporting molecule. The overcoating layer can be formed, for example, from a solution or other suitable mixture of the film-forming resin and hole transporting molecule.

The film-forming resin used in forming the overcoating layer can be any suitable film-forming resin, including any of those described above or us in the other layers of the imaging member. In embodiments, the film-forming resin can be electrically insulating, semi-conductive, or conductive, and can be hole transporting or not hole transporting. Thus, for example, suitable film-forming resins can be selected from, but are not limited to, thermoplastic and thermosetting resins such as polycarbonates, polyesters, polyamides, polyurethanes, polystyrenes, polyarylethers, polyarylsulfones, polysulfones, polyethersulfones, polyphenylene sulfides, polyvinyl acetate, polyacrylates, polyvinyl acetals, polyamides, polyimides, amino resins, phenylene oxide resins, phenoxy resins, epoxy resins, phenolic resins, polystyrene and acrylonitrile copolymers, vinyl acetate copolymers, acrylate copolymers, alkyd resins, styrenebutadiene copolymers, styrene-alkyd resins, polyvinylcarbazole, and the like. These polymers may be block, random or alternating copolymers.

In embodiments, the film-forming resin can be a polyester polyol, preferably a highly branched polyester polyol. By "highly branched" is meant a prepolymer synthesized using a significant amount of trifunctional alcohols, such as triols, to form a polymer having a significant number of branches off of the main polymer chain. This is distinguished from a linear prepolymer that contains only difunctional monomers, and thus little or no branches off of the main polymer chain. As used herein, "polyester polyol" is meant to encompass such compounds that include multiple ester groups as well as multiple alcohol (hydroxyl) groups in the molecule, and which can include other groups such as, for example, ether groups and the like. In embodiments, the polyester polyol can thus include ether groups, or can be free of ether groups.

It has been found that such polyester polyols provide improved results when incorporated as a binder in the overcoating layer, particularly when combined with the terphenyl arylamine hole transporting molecule. Specifically, the polyester polyols provide hard binder layers, but which layers remain flexible and are not prone to crack formation.

Examples of such suitable polyester polyols include, for example, polyester polyols formed from the reaction of a polycarboxylic acid such as a dicarboxylic acid or a tricarboxylic acid (including acid anhydrides) with a polyol such as a diol or a triol. Preferably, the number of ester and alcohol groups, and the relative amount and type of polyacid and polyol, should be selected such that the resulting polyester polyol compound retains a number of free hydroxyl groups, which can be used for subsequent crosslinking of the material in forming the overcoating layer binder material. For example, suitable polycarboxylic acids include, but are not limited to, adipic acid ($COOH[CH_2]_4COOH$), pimelic acid ($COOH[CH_2]_5COOH$), suberic acid ($COOH[CH_2]_6COOH$), azelaic acid ($COOH[CH_2]_7COOH$), sebasic acid ($COOH[CH_2]_8COOH$), and the like. Suitable polyols include, but are not limited to, difunctional materials such as glycols or trifunctional alcohols such as triols and the like, including propanediols ($HO[CH_2]_3OH$), butanediols ($HO[CH_2]_4OH$), hexanediols ($HO[CH_2]_6OH$), glycerine ($HOCH_2CHOHCH_2OH$), 1,2,6-Hexane triol ($HOCH_2CHOH[CH_2]_4OH$), and the like.

In embodiments, the suitable polyester polyols are reaction products of polycarboxylic acids and polyols and can be represented by the following formula (1):

$$[—CH_2—R_a—CH_2]_m—[—CO_2—R_b—CO_2—]_n—[—CH_2—R_c—CH_2]_p—[—CO_2—R_d—CO_2—]_q \quad (1)$$

where Ra and Rc independently represent linear alkyl groups or branched alkyl groups derived from the polyols, the alkyl groups having from 1 to about 20 carbon atoms; Rb and Rd independently represent alkyl groups derived from the polycarboxylic acids, the alkyl groups having from 1 to about 20 carbon atoms; and m, n, p, and q represent mole fractions of from 0 to 1, such that n+m+p+q=1.

Specific commercially available examples of such suitable polyester polyols include, for example: the DESMOPHEN® series of products available from Bayer Chemical, including the DESMOPHEN® 800, 1110, 1112, 1145, 1150, 1240, 1262, 1381, 1400, 1470, 1630, 2060, 2061, 2062, 3060, 4027, 4028, 404, 4059, 5027, 5028, 5029, 5031, 5035, and 5036 products; the SOVERMOL® series of products available from Cognis, including the SOVERMOL® 750, 805, 815, 908, 910, and 913 products; and the HYDAGEN® series of products available from Cognis, including the HYDAGEN® HSP product; and mixtures thereof. Particularly preferred in embodiments are DESMOPHEN® 800 and SOVERMOL® 750, or mixtures thereof. DESMOPHEN® 800 is a highly branched polyester bearing hydroxyl groups, having an acid value of ≦4 mg KOH/g, a hydroxyl content of about 8.6±0.3%, and an equivalent weight of about 200. DESMOPHEN® 800 corresponds to the above formula (1) where the polymer contains 50 parts adipic acid, 10 parts phthalic anhydride, and 40 parts 1,2,6-hexanetriol, where Rb=—$[CH_2]_4$—, n=0.5, Rd=--1,2-$C_6H_4$—, q=0.1, Ra=Rc=—$CH_2[CHO—][CH_2]_4$—, and m+p=0.4. DESMOPHEN® 1100 corresponds to the above formula (1) where the polymer contains 60 parts adipic acid, 40 parts 1,2,6-hexanetriol, and 60 parts 1,4-butanediol, where Rb=Rd=—$[CH_2]_4$—, n+q=0.375, Ra=—$CH_2[CHO—][CH_2]_4$—, m=0.25, Rc=—$[CH_2]_4$—, and p=0.375. SOVERMOL® 750 is a branched polyether/polyester/polyol having an acid value of ≦2 mg KOH/g, and a hydroxyl value of 300-330 mg KOH/g.

In other embodiments, the film-forming resin can be a acrylated polyol. Suitable acrylated polyols can be, for example, the reaction products of propylene oxide modified with ethylene oxide, glycols, triglycerol and the like. Such polyols can be represented by the following formula (2):

$$[R_t—CH_2]_t—[—CH_2—R_a—CH_2]_p—[—CO—R_b—CO—]_n—[—CH_2—R_c—CH_2]_p—[—CO—R_d—CO—]_q \quad (2)$$

where $R_t$ represent $CH_2CR_1CO_2$— where R1=methyl, ethyl, etc., where Ra and Rc independently represent linear alkyl or alkoxy groups or branched alkyl or alkoxy groups derived from the polyols, the alkyl and alkoxy groups having from 1 to about 20 carbon atoms; Rb and Rd independently represent alkyl or alkoxy groups, the alkyl and alkoxy groups having from 1 to about 20 carbon atoms; and m, n, p, and q represent mole fractions of from 0 to 1, such that n+m+p+q=1.

In forming the binder material for the overcoating layer in embodiments where the binder is a polyester polyols, polyol, or a combination, any suitable crosslinking agents, catalysts, and the like can be included in known amounts for known purposes. For example, it is particularly preferred in embodiments that a crosslinking agent or accelerator, such as a melamine crosslinking agent or accelerator, be included with the polyester polyol for forming the overcoating layer. Incorporation of a crosslinking agent or accelerator provides reaction sites to interact with the polyester polyol, to provide a branched, crosslinked structure. When so incorporated, any suitable crosslinking agent or accelerator can be used, including, for example, trioxane, melamine compounds, and mixtures thereof. Where melamine compounds are used, they can be suitable functionalized to be, for example, melamine formaldehyde, methoxymethylated melamine compounds, such as glycouril-formaldehyde and benzoguanamine-formaldehyde, and the like. An example of a suitable methoxymethylated melamine compound is Cymel 303 (available from Cytec Industries), which is a methoxymethylated melamine compound with the formula $(CH_3OCH_2)_6N_3C_3N_3$ and the following structure:

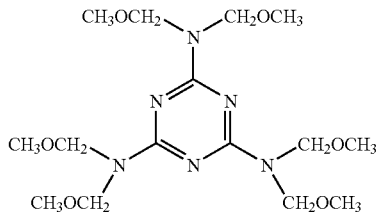

Crosslinking is generally accomplished by heating in the presence of a catalyst. Thus, the solution of the polyester polyol can also preferably include a suitable catalyst. Any suitable catalyst may be employed. Typical catalysts include, for example, oxalic acid, maleic acid, carbollylic acid, ascorbic acid, malonic acid, succinic acid, tartaric acid, citric acid, p-toluenesulfonic acid, methanesulfonic acid, and the like and mixtures thereof.

If desired or necessary, a blocking agent can also be included. A blocking agent can be used to "tie up" or block the acid effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine and commercial acid solutions containing blocking agents such as Cycat 4040 available from Cytec Ind.

The temperature used for crosslinking varies with the specific catalyst and heating time utilized and the degree of crosslinking desired. Generally, the degree of crosslinking selected depends upon the desired flexibility of the final photoreceptor. For example, complete crosslinking may be used for rigid drum or plate photoreceptors. However, partial crosslinking is preferred for flexible photoreceptors having, for example, web or belt configurations. The degree of crosslinking can be controlled by the relative amount of catalyst employed. The amount of catalyst to achieve a desired degree of crosslinking will vary depending upon the specific coating solution materials, such as polyester polyol/acrylated polyol, catalyst, temperature and time used for the reaction. Preferably, the polyester polyol/acrylated polyol is cross linked at a temperature between about 100° C. and about 150° C. A typical cross linking temperature used for polyester polyols/acrylated polyols with p-toluenesulfonic acid as a catalyst is less than about 140° C. for about 40 minutes. A typical concentration of acid catalyst is between about 0.01 and about 5.0 weight percent based on the weight of polyester polyol/acrylated polyol. After crosslinking, the overcoating should be substantially insoluble in the solvent in which it was soluble prior to crosslinking. Thus, no overcoating material will be removed when rubbed with a cloth soaked in the solvent. Crosslinking results in the development of a three dimensional network which restrains the transport molecule in the crosslinked polymer network.

Any suitable alcohol solvent may be employed for the film forming polymers. Typical alcohol solvents include, for example, butanol, propanol, methanol, 1-methoxy-2-propanol, and the like and mixtures thereof. Other suitable solvents that can be used in forming the overcoating layer solution include, for example, tetrahydrofuran, monochlorobenzene, and mixtures thereof. These solvents can be used in addition to, or in place of, the above alcohol solvents, or they can be omitted entirely. However, in some embodiments, it is preferred that higher boiling alcohol solvents be avoided, as they can interfere with the desired crosslinking reaction.

A suitable hole transport material is utilized in the overcoat layer, to improve the charge transport mobility of the layer. Preferably, the hole transport material is a terphenyl hole transporting molecule, preferably a terphenyl diamine hole transporting molecule. In embodiments, the hole transporting molecule is alcohol-soluble, to assist in its application along with the polymer binder in solution form. However, alcohol solubility is not required, and the combined hole transporting molecule and polymer binder can be applied by methods other than in solution, as needed. In embodiments, the terphenyl hole transporting molecule is represented by the following formula:

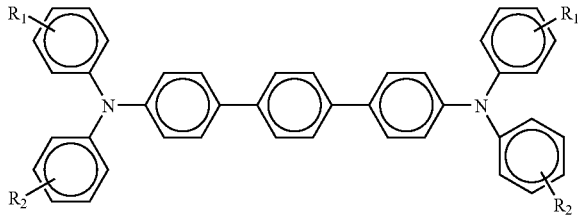

where each $R_1$ and $R_2$ are independently selected from the group consisting of —H, —OH, alkyl (—$C_nH_{2n+1}$) where n is from 1 to about 10 such as from 1 to about 5 or from 1 to about 6, aralkyl, and aryl groups, the aralkyl and aryl groups having, for example, from about 5 to about 30, such as about 6 to about 20, carbon atoms. Suitable examples of aralkyl groups include, for example, —$C_nH_{2n}$-phenyl groups where n is from 1 to about 5 or from 1 to about 10. Suitable examples of aryl groups include, for example, phenyl, naphthyl, biphenyl, and the like. In one embodiment, each $R_1$ is —OH, to provide a dihydroxy terphenyl diamine hole transporting molecule. For example, where each $R_1$ is —OH and each $R_2$ is —H, the resultant compound is N,N'-diphenyl-N,N'-di[3-hydroxyphenyl]-terphenyl-diamine. In another embodiment, each $R_1$ is —OH, and each R2 is independently an alkyl, aralkyl or aryl group as defined above. In embodiments, the hole transport material is soluble in the selected solvent used in forming the overcoating layer.

Any suitable alcohol solvent may be employed for applying the film forming polymer and terphenyl hole transporting molecule. Typical alcohol solvents include, for example, butanol, propanol, methanol, and the like and mixtures thereof. Other suitable solvents that can be used in forming the overcoating layer solution include, for example, tetrahydrofuran, monochloro benzene, and mixtures thereof. These solvents can be used in addition to, or in place of, the above alcohol solvents, or they can be omitted entirely.

All the components utilized in the overcoating solution of this disclosure should preferably be soluble in the solvents or solvents employed for the overcoating. When at least one component in the overcoating mixture is not soluble in the solvent utilized, phase separation can occur, which would adversely affect the transparency of the overcoating and electrical performance of the final imaging member.

The thickness of the continuous overcoat layer selected depends upon the abrasiveness of the charging (e.g., bias charging roll), cleaning (e.g., blade or web), development (e.g., brush), transfer (e.g., bias transfer roll), etc., in the system employed and can range from about 1 or about 2 microns up to about 10 or about 15 microns or more. A thickness of between about 1 micrometer and about 5 micrometers in thickness is preferred, in embodiments. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this disclosure should transport holes during imaging and should not have too high a free carrier concentration. Free carrier concentration in the overcoat increases the dark decay. Preferably the dark decay of the overcoated layer should be about the same as that of the unovercoated device.

In the dried overcoating layer, the composition can include from about 40 to about 90 percent by weight film-forming binder, and from about 60 to about 10 percent by weight terphenyl hole transporting molecule. For example, in embodiments, the terphenyl hole transporting molecule can be incorporated into the overcoating layer in an amount of from about 20 to about 50 percent by weight. As desired, the overcoating layer can also include other materials, such as conductive fillers, abrasion resistant fillers, and the like, in any suitable and known amounts.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

Preparation of Terphenyl Diamine Coating Composition

A coating composition is formed containing the terphenyl diamine N,N'-diphenyl-N,N'-di[3-hydroxyphenyl]-terphenyl-diamine in a film forming binder. The coating composition is made by dissolving, in a one ounce bottle, 1 gram of PcZ 500 (a polycarbonate resin) in 5 grams toluene, 5 grams monochlorobenzene, and 2 grams tetrahydrofuran. Next, 0.5 grams of N,N'-diphenyl-N,N'-di[3-hydroxyphenyl]-terphenyl-diamine is added to make a 33% by weight solution.

Example 2

Preparation of Terphenyl Diamine Coating Composition

A coating composition is formed containing the terphenyl diamine N,N'-diphenyl-N,N'-di[3-hydroxyphenyl]-terphenyl-diamine in a film forming binder. The coating composition is made by dissolving, in a one ounce bottle, 1 gram of PcZ 500 (a polycarbonate resin) in 3 grams toluene, 5 grams monochlorobenzene, and 5 grams tetrahydrofuran. Next, 1.0 grams of N,N'-diphenyl-N,N'-di[3-hydroxyphenyl]-terphenyl-diamine is added to make a 50% by weight solution.

Example 3

Preparation of Terphenyl Diamine Coating Composition

A coating composition is formed containing N,N'-diphenyl-N,N'-di[3-hydroxyphenyl]-terphenyl-diamine in a film forming binder. The coating composition is made by dissolving, in a one ounce bottle, 1 gram of PcZ 400 (a polycarbonate resin) in 7 grams tetrahydrofuran. Next, 0.8 grams of N,N'-diphenyl-N,N'-di[3-hydroxyphenyl]-terphenyl-diamine is added to make a 44% by weight solution.

Comparative Example 4

Preparation of Diphenyl Diamine Coating Composition

Example 3 is repeated by dissolving, in a one ounce bottle, 1 gram of PcZ 400 (a polycarbonate resin) in 7 grams tetrahydrofuran. Next, 0.8 grams of N,N'-diphenyl-N,N'-bis(3-hydroxyphenyl)-[1,1'-biphenyl]-4,4'-diamine is added to make a 44% by weight solution.

Example 5

Preparation of Photogenerating Layers

An electrophotographic imaging member web stock is prepared by providing a 0.02 micrometer thick titanium layer coated on a biaxially oriented polyethylene naphthalate substrate (Kadalex, available from ICI Americas, Inc.) having a thickness of 3.5 mils (89 micrometers) and applying thereto, using a gravure coating technique and a solution containing 10 grams gamma aminopropyltriethoxy silane, 10.1 grams distilled water, 3 grams acetic acid, 684.8 grams of 200 proof denatured alcohol and 200 grams heptane. This layer is then allowed to dry for 5 minutes at 135° C. in a forced air oven. The resulting blocking layer has an average dry thickness of 0.05 micrometer measured with an ellipsometer.

An adhesive interface layer is then prepared by applying with extrusion process to the blocking layer a wet coating containing 5 percent by weight based on the total weight of the solution of polyester adhesive (Mor-Ester 49,000, available from Morton International, Inc.) in a 70:30 volume ratio mixture of tetrahydrofuran:cyclohexanone. The adhesive interface layer is allowed to dry for 5 minutes at 135° C. in a forced air oven. The resulting adhesive interface layer has a dry thickness of 0.065 micrometer The adhesive interface layer is thereafter coated with a photogenerating layer. The photogenerating layer dispersion is prepared by introducing 0.45 grams of Iupilon 200 (PC-Z 200) available from Mitsubishi Gas Chemical Corp and 50ml of tetrahydrofuran into a 4 oz. Glass bottle. To this solution is added 2.4 grams of hydroxygallium phthalocyanine and 300 grams of ⅛ inch (3.2 millimeter) diameter stainless steel shot. This mixture is then placed on a ball mill for 20 to 24 hours. Subsequently, 2.25 grams of PC-Z 200 is dissolved in 46.1 gm of tetrahydrofuran, then added to this OHGaPc slurry. This slurry is then placed on a shaker for 10 minutes. The resulting slurry is, thereafter, coated onto the adhesive interface by an extrusion application process to form a layer having a wet thickness of 0.25 mil. However, a strip about 10 mm wide along one edge of the substrate web bearing the blocking layer and the adhesive layer is deliberately left uncoated by any of the photogenerating layer material to facilitate adequate electrical contact by the ground strip layer that is applied later. This photogenerating layer is dried at 135° C. for 5 minutes in a forced air oven to form a dry thickness photogenerating layer having a thickness of 0.4 micrometer layer. These generator layers are used in subsequent examples.

Example 6

Preparation of Imaging Member

The photogenerating layers from Example 3 are coated with the transport layer compositions of Example 1. The coating compositions are applied using a 3 mil Bird bar applicator and dried in a forced air oven with an initial temperature of 40° C. then raised to 100° C. over 18 minutes. The films remain at 100° C. for an additional 12 minutes. The results are imaging members having a transport layer thickness of 11 microns.

Example 7

Preparation of Imaging Member

The photogenerating layers from Example 3 are coated with the transport layer compositions of Example 2. The coating compositions are applied using a 3 mil Bird bar applicator and dried in a forced air oven with an initial temperature of 40° C. then raised to 100° C. over 18 minutes. The films remain at 100° C. for an additional 12 minutes. The results are imaging members having a transport layer thickness of 9 microns.

Example 8

Preparation of Imaging Member

The photogenerating layers comprised of benzimidazole perylene.are coated with the transport layer compositions of Example 3. The coating compositions are applied using a 3 mil Bird bar applicator and dried in a forced air oven with an initial temperature of 40° C. then raised to 100° C. over 18 minutes. The films remain at 100° C. for an additional 12 minutes. The results are imaging members having a transport layer thickness of 14 microns.

Example 9

Preparation of Comparative Imaging Member

The photogenerating layers comprised of benzimidazole perylene.are coated with the transport layer compositions of comparative Example 4. The coating compositions are applied using a 3 mil Bird bar applicator and dried in a forced air oven with an initial temperature of 40° C. then raised to 100° C. over 18 minutes. The films remain at 100° C. for an additional 12 minutes. The results are imaging members having a transport layer thickness of 12 microns.

Example 10

Preparation of Imaging Member

The photogenerating layers comprised of benzimidazole perylene.are coated with the transport layer compositions of Example 3. The coating compositions are applied using a 3 mil Bird bar applicator and dried in a forced air oven with an initial temperature of 40° C. then raised to 100° C. over 18 minutes. The films remain at 100° C. for an additional 12 minutes. The results are imaging members having a transport layer thickness of 20 microns.

Comparative Example 11

Preparation of Comparative Imaging Member

The photogenerating layers comprised of benzimidazole perylene.are coated with the transport layer compositions of comparative Example 4. The coating compositions are applied using a 3 mil Bird bar applicator and dried in a forced air oven with an initial temperature of 40° C. then raised to 100° C. over 18 minutes. The films remain at 100° C. for an additional 12 minutes. The results are imaging members having a transport layer thickness of 18 microns.

Example 12

Preparation of Drum Photoreceptors

Electrophotographic imaging members are prepared by applying by dip coating a charge blocking layer onto the rough surface of an aluminum drum having a diameter of 3 cm and a length of 31 cm. The blocking layer coating mixture is a solution of 8 weight percent polyamide (nylon 6) dissolved in a 92 weight percent butanol, methanol and water solvent mixture. The butanol, methanol and water mixture percentages are 55, 36 and 9 percent by weight, respectively. The coating is applied at a coating bath withdrawal rate of 300 millimeters/minute. After drying in a forced air oven, the blocking layer has a thickness of 1.5 micrometers. The dried blocking layer is coated with a charge generating layer containing 2.5 weight percent hydroxy gallium phthalocyanine pigment particles, 2.5 weight percent polyvinylbutyral film forming polymer and 95 weight percent cyclohexanone solvent. The coating is applied at a coating bath withdrawal rate of 300 millimeters/minute. After drying in a forced air oven, the charge generating layer has a thickness of 0.2 micrometer. The drum is subsequently coated with a charge transport layer containing N,N'-diphenyl-N,N'-bis(3- methylphenyl)-1,1;-biphenyl-4,4'-diamine dispersed in polycarbonate binder (PCZ 300, available from the Mitsubishi Chemical Company). The charge transport coating mixture consists of 8 weight percent N,N'-diphenyl-N,N'-bis(3-methylphenyl)-1,1'-biphenyl-4,4;-diamine, 12 weight percent binder and 80 weight percent monochlorobenzene solvent. The coating is applied in a Tsukiage dip coating apparatus. After drying in a forced air oven for 45 minutes at 118° C., the transport layer has a dry thickness of 20 micrometers.

Example 13

Preparation of Terphenyl Overcoat

A coating composition is formed containing 2.5 grams Joncryl 587 (acrylated polyol from Johnson Polymers Inc.), 3.5 grams Cymel 303, 27 grams 1-methoxy-2-propanol (Dowanol PM), and 3.0 grams N,N'-diphenyl-N,N'-di[3-hydroxyphenyl]-terphenyl-diamine in a 1 ounce bottle. The components are mixed and the temperature is raised to about 40° C. until a complete solution is achieved. Next, 0.9 grams of p-toluenesulfonic acid/pyridine (8% acid/pyridine complex in 1-methoxy-2-propanol) (0.072 grams acid, 0.75% by weight) as catalyst is added.

Example 14

Preparation of an Overcoated Drum Photoreceptor

A drum from Example 6 is overcoated with the overcoat solution composition from Example 13. The coating composition is applied using a Tsukiage dip coating apparatus and dried at 125° C. for 40 minutes. The result is an imaging member having an overcoating layer thickness of about 3.0 microns.

Example 15

Imaging Member

In a one ounce brown bottle, 1.2 grams MAKROLON (PC-A from Bayer AG) was placed into 13.5 grams of methylene chloride and stirred with a magnetic bar. After the polymer was completely dissolved, 1.2 grams of impure N,N'-diphenyl-N,N'-bis(3-methylphenyl)-1,1'-biphenyl-4,4'--diamine was added. The mixture was stirred overnight to assure a complete solution. The solution was applied onto the photogenerator layer made according to Example 5, using a 4 mil Bird bar to form a coating. The coated device was then heated in a forced hot air oven where the air temperature was elevated from about 40° C. to about 100° C. over a 30 minute period to form a charge transport layer having a dry thickness of 29 micrometers.

Example 16

Overcoated Imaging Member

An imaging member from Example 15 was coated with the solution from Example 13, using a 0.125 mil Bird bar. After drying in a forced air oven for 2 minutes at 125° C., the overcoat layer had a dry thickness of 3 microns.

Example 17

Mobility Evaluation of Imaging Members

The imaging members of Examples 6 and 7 are prepared for time of flight measurements by applying a circular gold electrode of ⅜ inch diameter with a thickness of about 100 to 150 Angstroms with an Ar+ sputterer. The gold electrode is then connected to a variable high voltage source and the ground plane to the electric ground through a variable resistor. A digitizing oscilloscope connected parallel to this grounding resistor monitors the current. The devices are than exposed to a short light pulse from a UV-nitrogen pumped dye laser through the semi-transparent, blocking gold electrode to inject less than a few percent of charges that the device would capacitively hold. The time from the light pulse to the time of the demarcation point (marked by a sharp drop off) of the current trace in the oscilloscope is then recorded as the transient time π of the leading edge of the transient charges in the device for the potential V. From the transient time the drift mobility μ is then computed through $$\mu = \frac{L^2}{V\tau}$$

where L is the device thickness. The computed drift mobilities are then fitted with $$\mu(E)=\mu_0 e^{-\beta\sqrt{E}}$$

obtain zero field mobility $\mu_o$ and the Pool-Frenkel like coefficient β for the field dependence.

FIG. 1 shows the mobilities of the imaging member devices of Examples 6 and 7. Table 1 lists their zero field mobilities, field coefficients and mobilities at a field of $10^5$ V/cm.

TABLE 1

| Sample | $\mu_o$ [$cm^2V^{-1}s^{-1}$] | β [$cm^{0.5}V^{-0.5}$] | μ (E = $10^5$ V/cm) [$cm^2V^{-1}s^{-1}$] |
|---|---|---|---|
| Example 6 | $3.42 \cdot 10^{-8}$ | $6.75 \cdot 10^{-3}$ | $2.9 \cdot 10^{-7}$ |
| Example 7 | $6.64 \cdot 10^{-8}$ | $6.92 \cdot 10^{-3}$ | $5.6 \cdot 10^{-7}$ |

Figure 2:
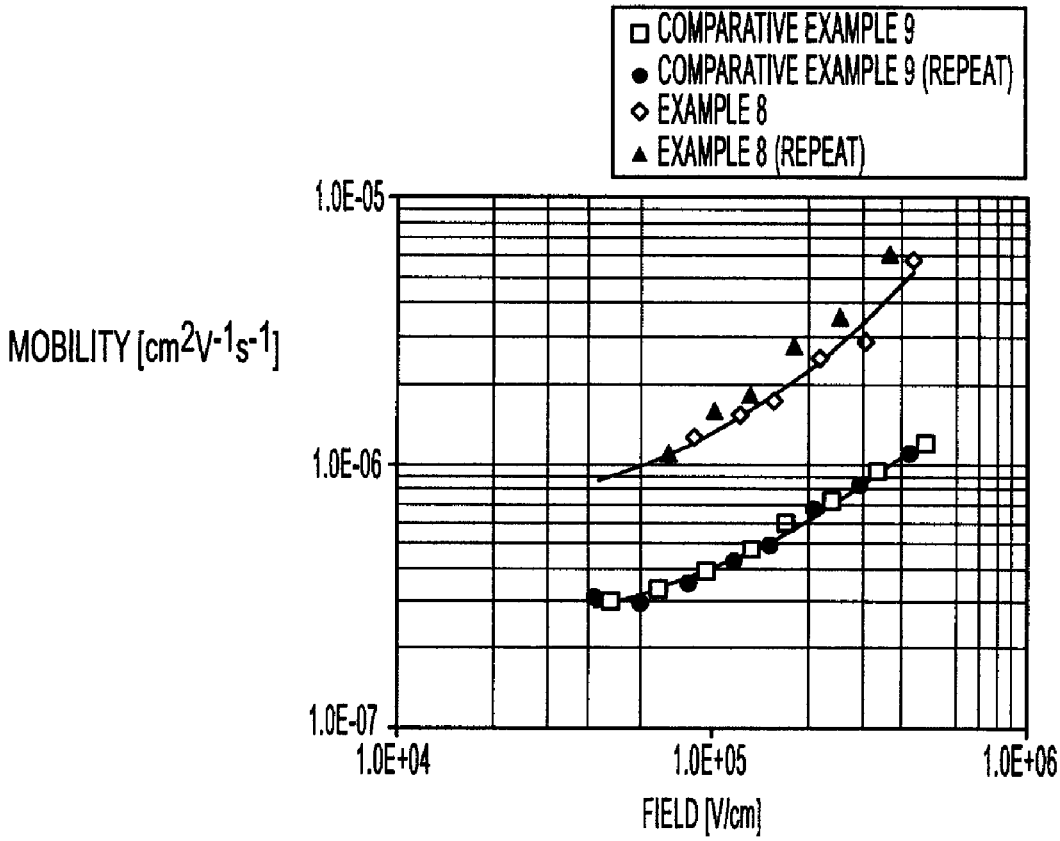
FIG. 2 is a graph showing a relationship between mobility and field for an exemplary imaging member and a comparative imaging member.

The imaging members of Examples 8 and 9 are prepared for time of flight measurements in the same manner as in Examples 6 and 7. FIG. 2 shows the mobilities of devices in Examples 8 and 9. Filled figures are repeats. Table 2 lists their zero field mobilities, field coefficients and mobilities at a field of $10^5$ V/cm.

TABLE 2

| Sample | $\mu_o$ [$cm^2V^{-1}s^{-1}$] | β [$cm^{0.5}V^{-0.5}$] | μ (E = $10^5$ V/cm) [$cm^2V^{-1}s^{-1}$] |
|---|---|---|---|
| Comp Ex. 9 | $1.56 \cdot 10^{-8}$ | $3.06 \cdot 10^{-3}$ | $4.1 \cdot 10^{-7}$ |
| Example 8 | $3.69 \cdot 10^{-8}$ | $4.02 \cdot 10^{-3}$ | $1.3 \cdot 10^{-6}$ |

Figure 3:
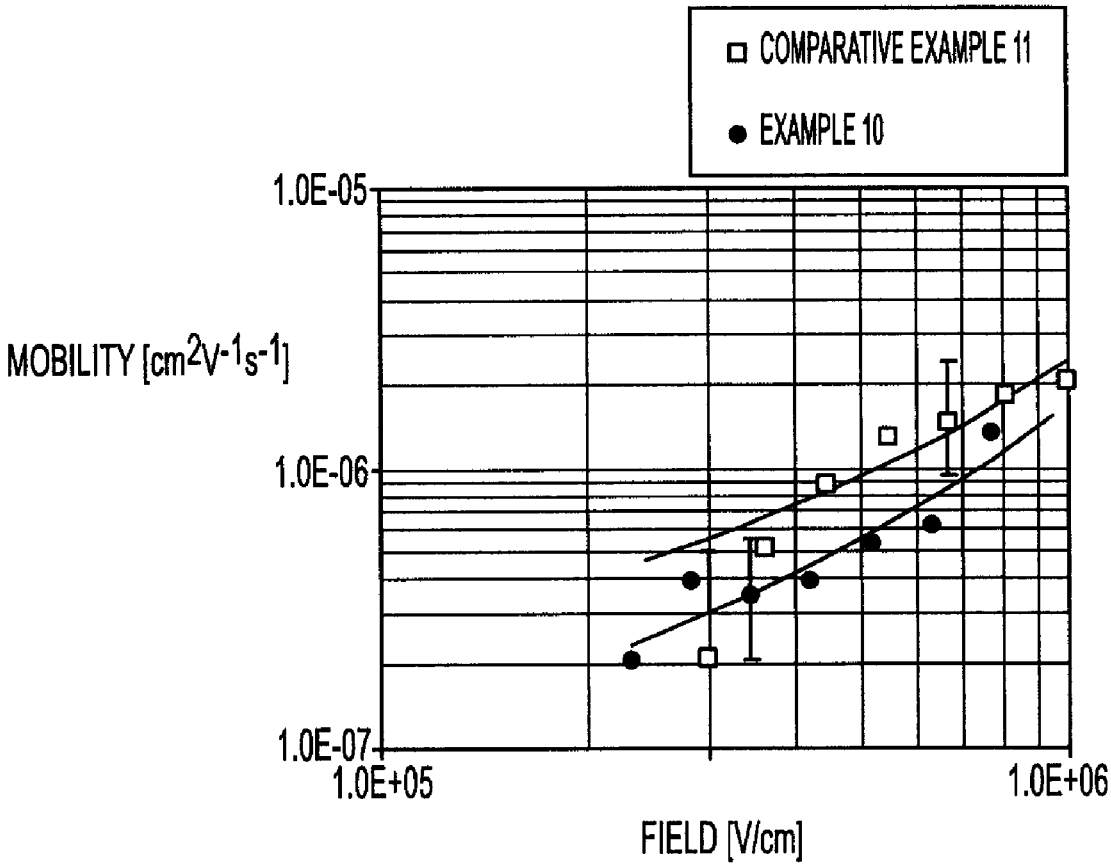
FIG. 3 is a graph showing a relationship between mobility and field for an exemplary imaging member and a comparative imaging member.

The imaging members of Examples 10 and 11 are prepared for time of flight measurements in the same manner as in Examples 6 and 7. FIG. 3 shows the mobilities of devices in Examples 10 and 11. The transport is very dispersive and demarcation points are not always clear. Up to 4 samples of each device are electroded and several times measured. Error bars indicate typical ranges. Table 3 lists their zero field mobilities, field coefficients and mobilities at a field of $5 \cdot 10^5$ V/cm.

TABLE 3

| Sample | $\mu_o$ [$cm^2V^{-1}s^{-1}$] | β [$cm^{0.5}V^{-0.5}$] | μ (E = $10^5$ V/cm) [$cm^2V^{-1}s^{-1}$] |
|---|---|---|---|
| Comp. Ex. 11 | $3.67 \cdot 10^{-8}$ | $3.84 \cdot 10^{-3}$ | $5.6 \cdot 10^{-7}$ |
| Example 10 | $9.22 \cdot 10^{-8}$ | $3.28 \cdot 10^{-3}$ | $9.4 \cdot 10^{-7}$ |

Example 18

Electrical Evaluation of Imaging Members

The imaging members of Example 15 and Example 16 are tested for their electrostatographic sensitivity and cycling stability in a scanner. In the scanner, each photoreceptor sheet to be evaluated is mounted on a cylindrical aluminum drum substrate that is rotated on a shaft. The devices are charged by a corotron mounted along the periphery of the drum. The surface potential is measured as a function of time by capacitively coupled voltage probes placed at different locations around the shaft. The probes are calibrated by applying known potentials to the drum substrate. Each photoreceptor sheet on the drum is exposed to a light source located at a position near the drum downstream from the corotron. As the drum is rotated, the initial (pre-exposure) charging potential is measured by voltage probe 1. Further rotation leads to an exposure station, where the photoreceptor device is exposed to monochromatic radiation of a known intensity. The devices are erased by a light source located at a position upstream of charging. The measurements illustrated in the Table below include the charging of each photoconductor device in a constant current or voltage mode. The devices are charged to a negative polarity corona. The surface potential after exposure is measured by a second voltage probe. The devices are finally exposed to an erase lamp of appropriate intensity and any residual potential is measured by a third voltage probe. The process is repeated with the magnitude of the exposure automatically changed during the next cycle. The photodischarge characteristics are obtained by plotting the potentials at voltage probe 2 as a function of light exposure. The following results show that there is no significant difference between the imaging member having no overcoat (Example 15) and the imaging member having an overcoat (Example 16).

| # cycles | Example | V(1.5) | V(2.5) | V(6) |
|---|---|---|---|---|
| 0 | 15 | 133 | 52 | 40 |
| | 16 | 130 | 54 | 39 |
| 10,000 | 15 | 152 | 71 | 44 |
| | 16 | 169 | 94 | 65 |

It will be appreciated that various of the above-disclosed and other features and functions, or alternatives thereof, may be desirably combined into many other different systems or applications. Also that various presently unforeseen or unanticipated alternatives, modification, variations or improvements therein may be subsequently made by those skilled in the are which are also intended to be encompassed by the following claims.

What is claimed is:

1. An electrophotographic imaging member comprising:

a substrate, a charge generating layer, a charge transport layer, and an overcoating layer, said overcoating layer comprising a terphenyl arylamine dissolved or molecularly dispersed in a cured polyester polyol or a cured acrylated polyol, wherein:

the terphenyl arylamine is represented by the formula:

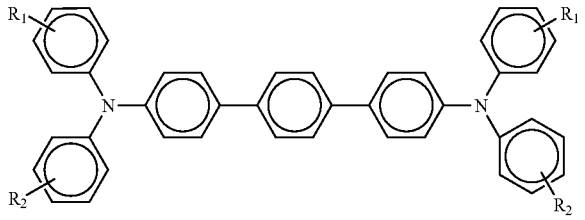

where each $R_1$ and $R_2$ are independently selected from the group consisting of —H, —OH, $—C_nH_{2n+1}$ where n is from 1 to about 10, aralkyl, and aryl groups, the aralkyl and aryl groups having from about 5 to about 30 carbon atoms;

the cured polyester polyol is represented by the formula:

$$(—CH_2—R_a—CH_2)_m—(—CO_2—R_b—CO_2—)_n—(—CH_2—R_c—CH_2)_p—(—CO_2—R_d—CO_2—)_q$$

where $R_a$ and $R_c$ independently represent linear alkyl groups or branched alkyl groups derived from the polyols, the alkyl groups having from 1 to about 20 carbon atoms; $R_b$ and $R_d$ independently represent alkyl groups derived from polycarboxylic acids, the alkyl groups having from 1 to about 20 carbon atoms; and m, n, p, and q represent mole fractions of from 0 to 1, such that n+m+p+q=1; and the cured acrylated polyol is represented by the formula:

$$(R_t—CH_2)_m—(—CH_2—R_e—CH_2)_p—(—CO—R_f—CO—)_n—(—CH_2—R_g—CH_2)_p—(—CO—R_h—CO—)_q$$

where $R_t$ represents $CH_2CR_1CO_2$— where $R_3$=an organic group, where $R_e$ and $R_g$ independently represent linear alkyl or alkoxy groups or branched alkyl or alkoxy groups derived from the polyols, the alkyl and alkoxy groups having from 1 to about 20 carbon atoms; $R_f$ and $R_h$ independently resent alkyl or alkoxy groups, the alkyl and alkoxy groups having from 1 to about 20 carbon atoms; and m, n, p, and q represent mole fractions of from 0 to 1, such that n+m+p+q=1.

2. The electrophotographic imaging member of claim 1 wherein each $R_1$ is —OH and each $R_2$ is selected from the group consisting of $C_nH_{2n+1}$, where n is from 5 to about 10, aralkyl and aryl groups.

3. The electrophotographic imaging member of claim 1, wherein the polymer binder is cured polyester polyol and the cured polyester polyol is a branched polyester polyol.

4. The electrophotographic imaging member of claim 1, wherein the polymer binder is cured acrylated polyol and the cured acrylated polyol is a branched acrylated polyol.

5. The electrophotographic imaging member of claim 1, wherein the overcoating layer comprises from about 10 to about 60 percent by weight terphenyl arylamine and from about 90 to about 40 percent by weight polymer binder.

6. The electrophotographic imaging member of claim 1, wherein the overcoating layer comprises from about 20 to about 50 percent by weight terphenyl arylamine and from about 80 to about 50 percent by weight polymer binder.

7. A process for forming an electrophotographic imaging member comprising:

providing an electrophotographic imaging member comprising a substrate, a charge generating layer, and a charge transport layer, and forming thereover an overcoating layer comprising a terphenyl arylamine dissolved or molecularly dispersed in a cured polyester polyol or a cured acrylated polyol, wherein:

the terphenyl arylamine is represented by the formula:

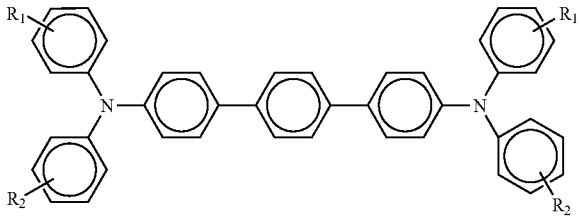

where each $R_1$ and $R_2$ are independently selected from the group consisting of —H, —OH, —$C_nH_{2n+1}$ where n is from 1 to about 10, aralkyl, and aryl groups, the aralkyl and aryl groups having from about 5 to about 30 carbon atoms;

the cured polyester polyol is represented by the formula:

$$(—CH_2—R_a—CH_2)_m—(—CO_2—R_b—CO_2—)_n—(—CH_2—R_c—CH_2)_p—(—CO_2—R_d—CO_2—)_q$$

where $R_a$ and $R_c$ independently represent linear alkyl groups or branched alkyl groups derived from the polyols, the alkyl groups having from 1 to about 20 carbon atoms; $R_b$ and $R_d$ independently represent alkyl groups derived from polycarboxylic acids, the alkyl groups having from 1 to about 20 carbon atoms; and m, n, p, and q represent mole fractions of from 0 to 1, such that n+m+p+q=1; and the cured acrylated polyol is represented by the formula:

$$(R_t—CH_2)_m—(—CH_2—R_e—CH_2)_p—(—CO—R_f—CO—)_n—(—CH_2—R_g—CH_2)_p—(—CO—R_h—CO—)_q$$

where $R_t$ represents $CH_2CR_1CO_2$— where $R_3$=an organic group, where $R_e$ and $R_g$ independently represent linear alkyl or alkoxy groups or branched alkyl or alkoxy groups derived from the polyols, the alkyl and alkoxy groups having from 1 to about 20 carbon atoms; $R_f$ and $R_h$ independently represent alkyl groups, the alkyl and alkoxy groups having from 1 to about 20 carbon atoms; and m, n, p, and q represent mole fractions of from 0 to 1, such that n+m+p+q=1.

8. The process of claim 7, wherein each $R_1$ is —OH and each $R_2$ is selected from the group consisting of —$C_nH_{2n+1}$, where n is from 5 to about 10, aralkyl and aryl groups.

9. The process of claim 7, wherein the polymer binder is cured polyester polyol and the cured polyester polyol is a branched polyester polyol.

10. The process of claim 7, wherein the overcoating layer comprises from about 10 to about 60 percent by weight terphenyl arylamine and from about 90 to about 40 percent by weight polymer binder.

11. The process of claim 7, wherein the overcoating layer comprises from about 20 to about 50 percent by weight terphenyl arylamine and from about 80 to about 50 percent by weight polymer binder.

12. The process of claim 7, wherein the overcoating layer is formed from a solution comprising said terphenyl arylamine and said polymer binder in an alcohol solvent.

13. The process of claim 12, wherein the solution further comprises a non-alcohol solvent.

14. An electrographic image development device, comprising an electrophotographic imaging member comprising:

a substrate, a charge generating layer, a charge transport layer, and an overcoating layer, said overcoating layer comprising a terphenyl arylamine dissolved or molecularly dispersed in a cured polyester polyol or a cured acrylated polyol, wherein:

the coated member terphenyl arylamine is represented by the formula:

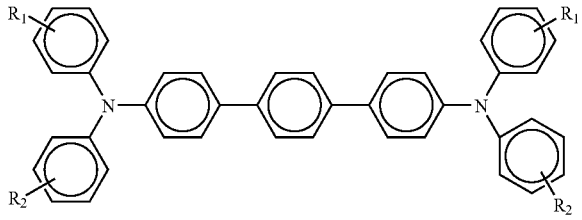

where each $R_1$ and $R_2$ are independently selected from the group consisting of —H, —OH, —$C_nH_{2n+1}$ where n is from 1 to about 10, aralkyl, and aryl groups, the aralkyl and aryl groups having from about 5 to about 30 carbon atoms;

the cured polyester polyol is represented by the formula:

$$(—CH_2—R_a—CH_2)_m—(—CO_2—R_b—CO_2—)_n—(—CH_2—R_c—CH_2)_p—(—CO_2—R_d—CO_2—)_q$$

where $R_a$ and $R_c$ independently represent linear alkyl groups or branched alkyl groups derived from the polyols, the alkyl groups having from 1 to about 20 carbon atoms; $R_b$ and $R_d$ independently represent alkyl groups derived from polycarboxylic acids, the alkyl groups having from 1 to about 20 carbon atoms; and m, n, p, and q represent mole fractions of from 0 to 1, such that n+m+p+q=1; and the cured acrylated polyol is represented by the formula:

$$(R_t—CH_2)_m—(—CH_2—R_e—CH_2)_p—(—CO—R_f—CO—)_n—(—CH_2—R_g—CH_2)_p—(—CO—R_h—CO—)_q$$

where $R_t$ represents $CH_2CR_1CO_2$— where $R_3$=an organic group, where $R_e$ and $R_g$ independently represent linear alkyl or alkoxy groups or branched alkyl or alkoxy groups derived from the polyols, the alkyl and alkoxy groups having from 1 to about 20 carbon atoms; $R_f$ and $R_h$ independently represent alkyl or alkoxy groups, the alkyl and alkoxy groups having from 1 to about 20 carbon atoms; and m, n, p, and q represent mole fractions of from 0 to 1, such that n+m+p+q=1.

15. The electrographic image development device of claim 14, wherein each $R_1$ is —OH and each $R_2$ is selected from the group consisting of —$C_nH_{2n+1}$, where n is from 5 to about 10, aralkyl and aryl groups.

* * * * *